US011420785B2

(12) United States Patent
Garza et al.

(10) Patent No.: US 11,420,785 B2
(45) Date of Patent: Aug. 23, 2022

(54) VALVE PACKING CARTON

(71) Applicant: ST9 GAS AND OIL, LLC, The Woodlands, TX (US)

(72) Inventors: Alfredo Amparan Garza, Magnolia, TX (US); Roberto Manuel Valenzuela Salmon, Magnolia, TX (US); David Eugenio Aguilar Gutierrez, Magnolia, TX (US); Christopher Paul Buckley, Montgomery, TX (US); Nicholas Alexander Poradek, The Woodlands, TX (US)

(73) Assignee: ST9 Gas and Oil, LLC, The Woodlands, TX (US)

( * ) Notice: Subject to any disclaimer, the term of this patent is extended or adjusted under 35 U.S.C. 154(b) by 406 days.

(21) Appl. No.: 16/565,101

(22) Filed: Sep. 9, 2019

(65) Prior Publication Data

US 2021/0070494 A1 Mar. 11, 2021

(51) Int. Cl.
*B65D 71/70* (2006.01)
*B65D 5/50* (2006.01)
*B65D 5/00* (2006.01)

(52) U.S. Cl.
CPC ..... *B65D 5/50* (2013.01); *B65D 5/001* (2013.01)

(58) Field of Classification Search
CPC ..... B65D 5/50; B65D 5/001; B65D 5/5078; B65D 5/5028; B65D 5/506; B65D 5/5073; B65D 71/70; A27G 23/02; A27G 23/06
USPC ..... 206/486, 521.6, 488, 590, 561; 229/120.08
See application file for complete search history.

(56) References Cited

U.S. PATENT DOCUMENTS 4,911,300 A * 3/1990 Colonna ..... B65D 71/50 206/427
6,290,057 B1 * 9/2001 Hurley ..... B65D 81/133 206/592
2008/0135445 A1 * 6/2008 Juliano ..... B65D 81/05 206/592
2015/0375919 A1 * 12/2015 Jaramillo de Echeverri ..... B65D 25/108 428/34.1

FOREIGN PATENT DOCUMENTS

WO WO-9413558 A1 * 6/1994 ..... B65D 85/322

* cited by examiner

*Primary Examiner* — King M Chu
(74) *Attorney, Agent, or Firm* — Haynes and Boone, LLP

(57) ABSTRACT

A packing carton for pump valves includes a base, a first set of opposing sides extending up from the base, and a second set of opposing sides extending up from the base, such that adjacent sides join together to form a corner. The packing carton further includes a first circular corner receptacle formed at a first corner, a second circular corner receptacle formed at a second corner and adjacent the first receptacle, a third circular corner receptacle formed at a third corner, and a fourth circular corner receptacle formed at a fourth corner and adjacent the third receptacle.

39 Claims, 6 Drawing Sheets

VALVE PACKING CARTON

TECHNICAL FIELD

The present application relates generally to packing cartons. More particularly, the present application relates to packing cartons accommodating a plurality of valve heads and/or valve seats.

BACKGROUND

It is difficult to economically produce hydrocarbons from low permeability reservoir rocks. Oil and gas production rates are often boosted by hydraulic fracturing, a technique that increases rock permeability by opening channels through which hydrocarbons can flow to recovery wells. Hydraulic fracturing has been used for decades to stimulate production from conventional oil and gas wells. The practice consists of pumping fluid into a wellbore at high pressure (sometimes as high as 50,000 PSI). Inside the wellbore, large quantities of proppants are carried in suspension by the fracture fluid into the fractures. When the fluid enters the formation, it fractures, or creates fissures, in the formation. Water, as well as other fluids, and some solid proppants, are then pumped into the fissures to stimulate the release of oil and gas from the formation. When the pressure is released, the fractures partially close on the proppants, leaving channels for oil and gas to flow.

Fracturing rock in a formation requires that the fracture fluid be pumped into the well bore at very high pressure. This pumping is typically performed by large diesel-powered pumps. These specialized pumps are used to deliver fracture fluids at sufficiently high rates and pressures to complete a hydraulic fracturing procedure or "frac job." The portion of these pumps that is in contact with the pumped fluid is called the "fluid end," within which a number of reciprocating plungers pressurize the fracture fluid. Suction and discharge valves control fluid flow to and from these plungers. These valves include valve heads that selectively contact a valve seat thereby regulating movement of the fracture fluid through the fluid end. Each valve head is subjected to the course contaminants within the fracture fluid and the repetitive or cyclical contacting of the valve seat. Over time, the combination of the coarse fracture fluid with the repetitive contact forces from the valve seat during operation leads to premature wear of the valve head.

Due to the wear on the valve heads, frequent maintenance and replacement of the valve heads is required to ensure proper function of the pumps. In some instances, valve heads may need replacement every two weeks to two months. Moreover, a single frac job may utilize 20 or more simultaneously operating pumps during a hydraulic fracturing operation, where each pump may have five or more valve heads. Each valve head is paired with a valve seat, which also may require periodic replacement. Due to the frequency of replacement and relatively large number of valve heads and/or valve seats needing replacement, there remains a need for a suitable packaging to transport the requisite number of valve heads and/or valve seats to a pump for maintenance.

BRIEF DESCRIPTION OF THE DRAWINGS

Embodiments of the subject matter are disclosed with reference to the accompanying drawings which are intended for illustrative purposes only. The subject matter is not limited in its application to the details of construction or the arrangement of the components illustrated in the drawings. Like reference numerals are used to indicate like components, unless otherwise indicated.

DETAILED DESCRIPTION

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

Figure 1:
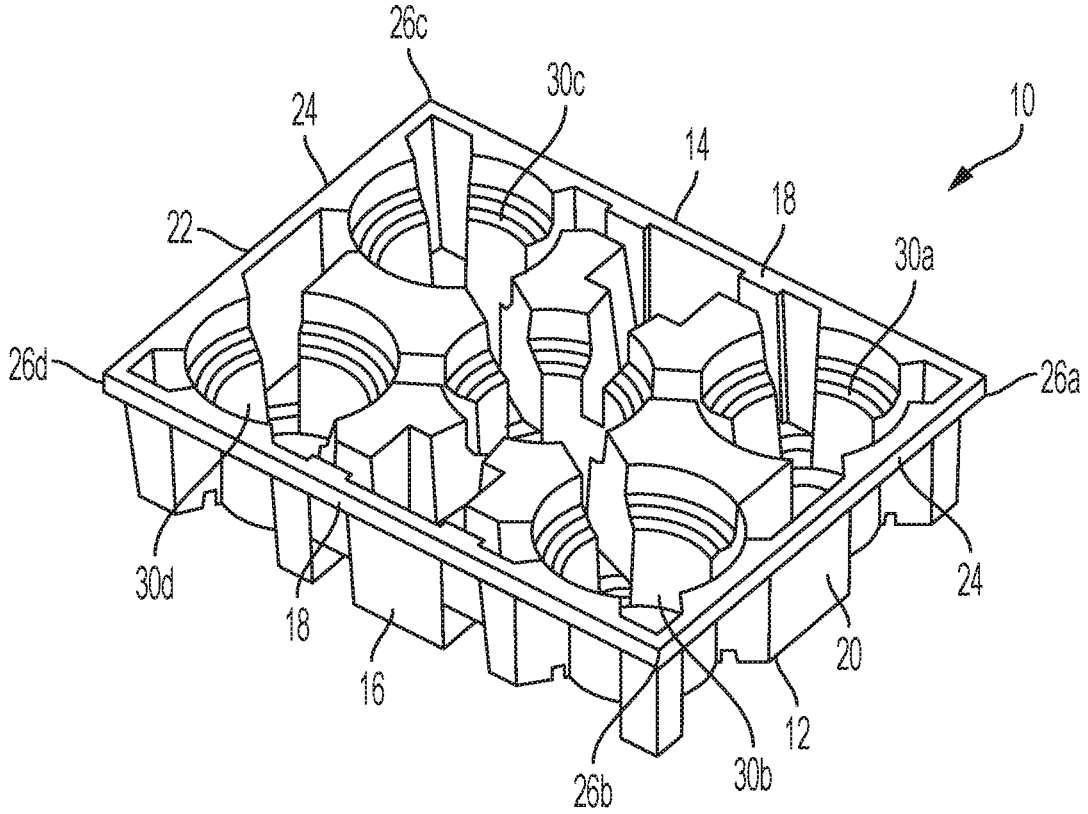
FIG. 1 is a perspective view of a packing carton according to the present disclosure.

According to one or more embodiments of the present disclosure, and with reference to the figures, a packing carton 10 includes a base 12 forming a bottom surface thereof. The base 12 may have a uniform surface or a non-uniform surface, and the base 12 may be continuous or non-continuous. The base 12 includes a first set of opposing sides 14, 16, each of which includes an upper edge 18. The base further includes a second set of opposing sides 20, 22, each of which includes an upper edge 24. Adjacent sides of the packing carton 10 join to forms corners. For instance, as shown in FIG. 1, side 20 forms a first corner 26*a* with adjacent side 14 and a second corner 26*b* with adjacent side 16, and side 22 forms a third corner 26*c* with adjacent side 14 and a fourth corner 26*d* with adjacent side 16.

As used herein, "side" refers to a portion of the carton generally formed along a plane that intersects the base 12 at an angle greater than zero, including but not limited to a plane that is generally perpendicular to the base. As used herein, "base" refers to the lowest portions of the packing carton 10, generally formed along the same plane. Neither the base 12 nor a side 14, 16, 20, 22 needs be a continuous surface in a plane.

A first corner receptacle 30*a* is formed at the first corner 26*a*, a second corner receptacle 30*b* is formed at the second corner 26*b*, a third corner receptacle 30*c* is formed at the third corner 26*c*, and a fourth corner receptacle 30*d* is formed at the fourth corner 26*d*. According to some embodiments, the second corner receptacle 30*b* is adjacent the first corner receptacle 30*a* and the fourth corner receptacle 30*d* is adjacent the third corner receptacle 30*c*. According to one or more embodiments, each receptacle 30*a*, 30*b*, 30*c*, 30*d* may be shaped to accommodate a valve head and/or valve seat. In some embodiments, each receptacle 30*a*, 30*b*, 30*c*, 30*d* is circular.

Figure 2:
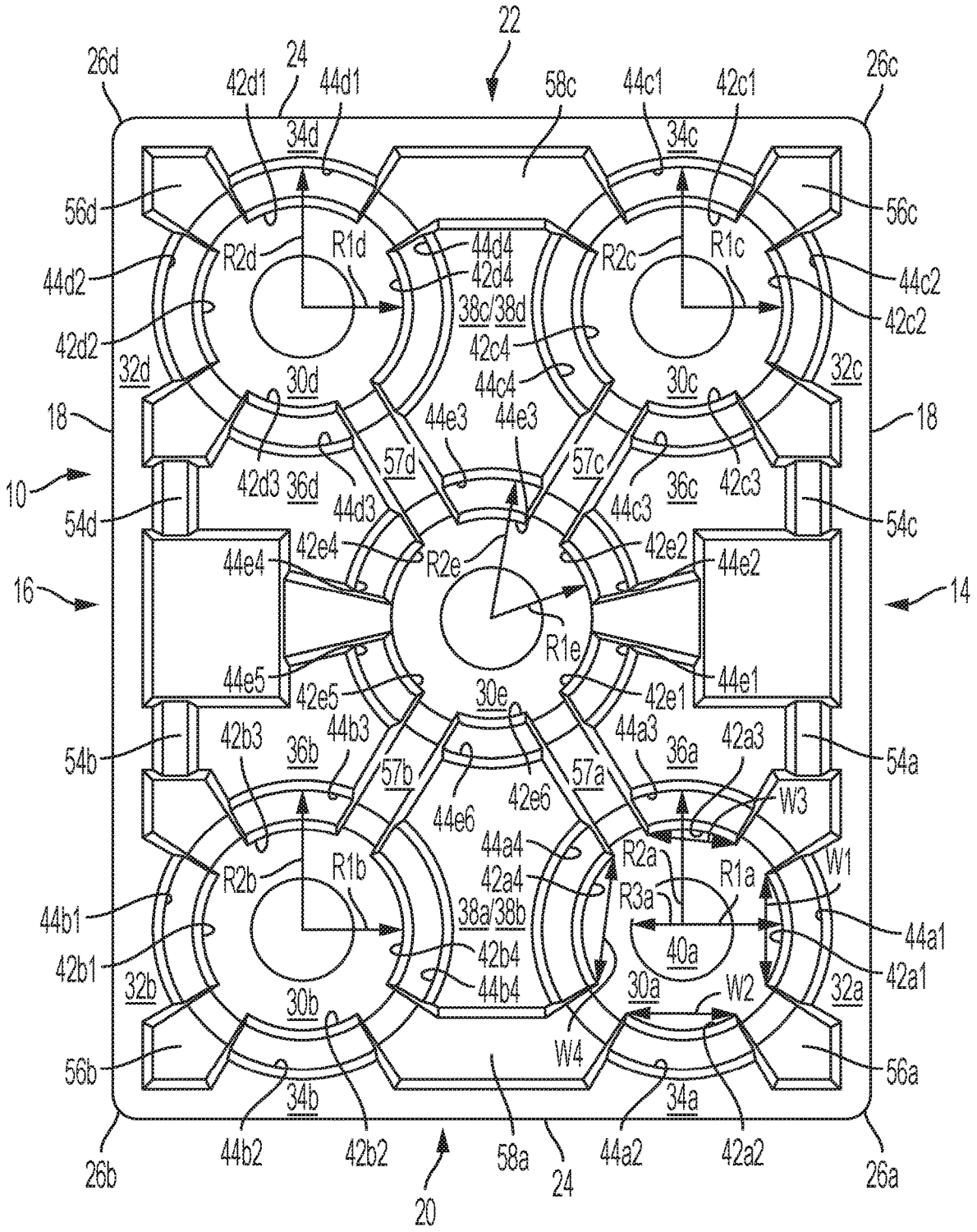
FIG. 2 is a top view of the packing carton shown in FIG. 1.
Figure 3:
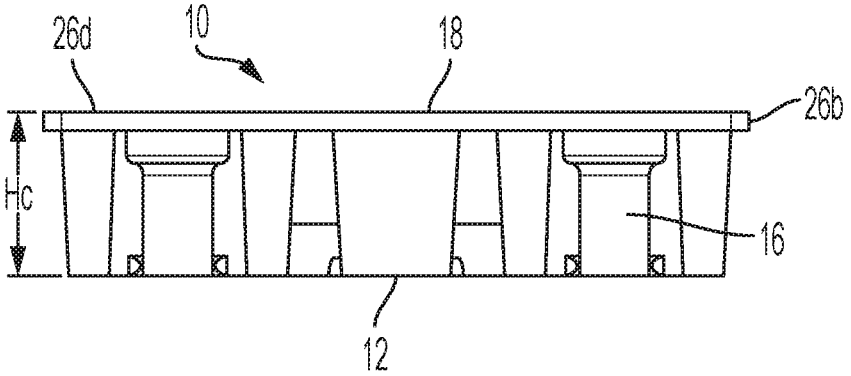
FIG. 3 is a side view of the packing carton shown in FIG. 1.
Figure 4:
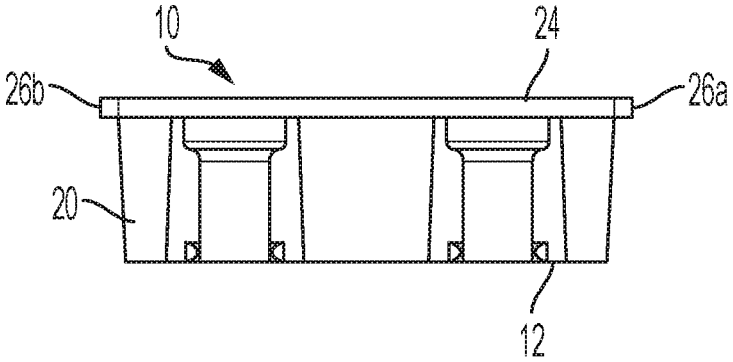
FIG. 4 is a front view of the packing carton shown in FIG. 1.
Figure 5:
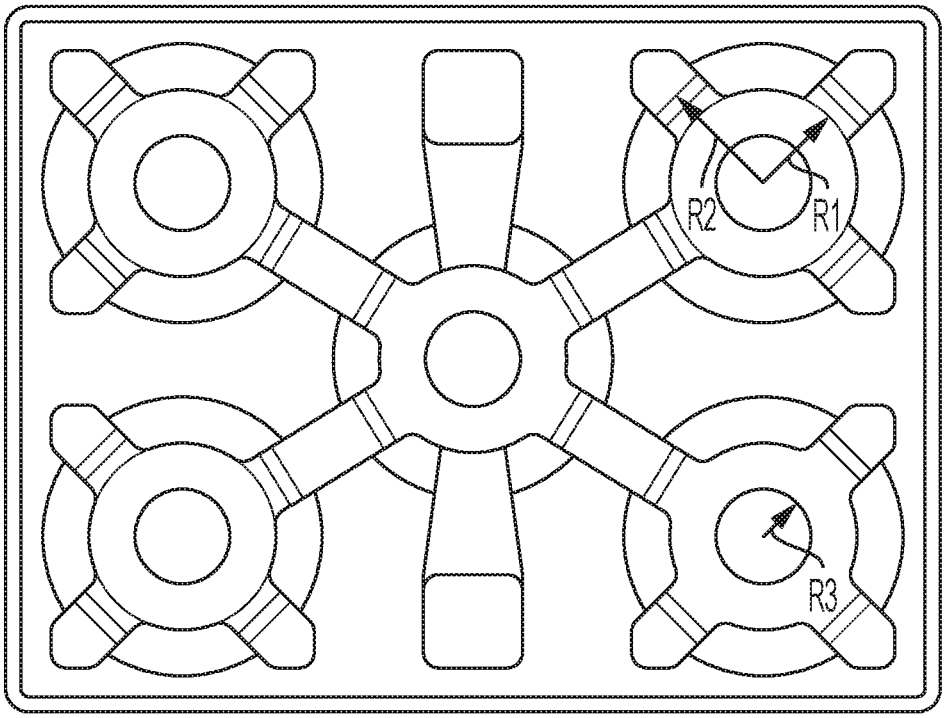
FIG. 5 is a bottom view of the packing carton shown in FIG. 1.

As best seen in FIG. 2, each corner receptacle 30*a*, 30*b*, 30*c*, 30*d* includes a respective first column 32*a*, 32*b*, 32*c*, 32*d* extending up from the base 12. The first column 32*a*, 32*b*, 32*c*, 32*d* is integrally formed with one of the first set of opposing sides 14, 16. The first column 32*a*, 32*b*, 32*c*, 32*d* includes an inwardly facing concave surface with a respective first surface portion 42*a*1, 42*b*1, 42*c*1, 42*d*1 adjacent the base 12 and a respective second surface portion 44*a*1, 44*b*1, 44*c*1, 44*d*1 adjacent the edge 18 of the side 14, 16 in which the column 32*a*, 32*b*, 32*c*, 32*d* is formed. The first surface portion 42*a*1, 42*b*1, 42*c*1, 42*d*1 is concave and has a respective first radius R1*a*, R1*b*, R1*c*, R1*d* and the second surface portion 44*a*1, 44*b*1, 44*c*1, 44*d*1 is concave and has a respective second radius R2*a*, R2*b*, R2*c*, R2*d* that is greater than the first radius R1*a*, R1*b*, R1*c*, R1*d*.

Each corner receptacle 30*a*, 30*b*, 30*c*, 30*d* further includes a second column 34*a*, 34*b*, 34*c*, 34*d* extending up from the base 12. The second column 34*a*, 34*b*, 34*c*, 34*d* is integrally formed with one of the second set of opposing sides 20, 22. The second column 34*a*, 34*b*, 34*c*, 34*d* includes an inwardly facing concave surface with a first surface portion 42*a*2, 42*b*2, 42*c*2, 42*d*2 adjacent the base 12 and a second surface portion 44*a*2, 44*b*2, 44*c*2, 44*d*2 adjacent the edge 24 of the side 20, 22 in which the column 34*a*, 34*b*, 34*c*, 34*d* is formed. The first surface portion 42*a*2, 42*b*2, 42*c*2, 42*d*2 is concave and has a first radius substantially the same as the first radius R1*a*, R1*b*, R1*c*, R1*d* of the first column 32*a*, 32*b*, 32*c*, 32*d* and the second surface portion 44*a*2, 44*b*2, 44*c*2, 44*d*2 is concave and has a second radius substantially the same as the second radius R2*a*, R2*b*, R2*c*, R2*d* of the first column 32*a*, 32*b*, 32*c*, 32*d*. In some embodiments, the first column 32*a*, 32*b*, 32*c*, 32*d* and the second column 34*a*, 34*b*, 34*c*, 34*d* are adjacent one another on their respective sides 14, 16, 20, 22 at a corner 26*a*, 26*b*, 26*c*, 26*d*.

Each corner receptacle 30*a*, 30*b*, 30*c*, 30*d* further includes a third column 36*a*, 36*b*, 36*c*, 36*d* extending up from the base 12 so as to be adjacent the first column 32*a*, 32*b*, 32*c*, 32*d* and opposite the second column 34*a*, 34*b*, 34*c*, 34*d*. In one or more embodiments, the third column 36*a*, 36*b*, 36*c*, 36*d* may be integrally formed with a side 14, 16, while in other embodiments, third column 36*a*, 36*b*, 36*c*, 36*d* may be spaced from the side 14,16. The third column 36*a*, 36*b*, 36*c*, 36*d* includes an inwardly facing concave surface with a first surface portion 42*a*3, 42*b*3, 42*c*3, 42*d*3 adjacent the base 12 and a second surface portion 44*a*3, 44*b*3, 44*c*3, 44*d*3. The first surface portion 42*a*3, 42*b*3, 42*c*3, 42*d*3 is concave and has a first radius substantially the same as the first radius R1*a*, R1*b*, R1*c*, R1*d* of the first column 32*a*, 32*b*, 32*c*, 32*d* and the second surface portion 44*a*3, 44*b*3, 44*c*3, 44*d*3 is concave and has a second radius substantially the same as the second radius R2*a*, R2*b*, R2*c*, R2*d* of the first column 32*a*, 32*b*, 32*c*, 32*d*.

In some embodiments, the third column 36*a* of the first corner receptacle 30*a* and the third column 36*c* of the third corner receptacle 30*c* may be integrally formed and/or the third column 36*b* of the second corner receptacle 30*b* and the third column 36*d* of the fourth corner receptacle 30*d* may be integrally formed. In such embodiments, a first concave surface (corresponding to the concave surface of the third column 36*a* of the first corner receptacle 30*a*) and a second concave surface (corresponding to the concave surface of the third column 36*c* of the third corner receptacle 30*c*) of the integrally formed third column of the first and third corner receptacles 30*a*, 30*c* may be formed on opposite sides of the integrally formed third column. Similarly, a first concave surface (corresponding to the concave surface of the third column 36*b* of the second corner receptacle 30*b*) and a second concave surface (corresponding to the concave surface of the third column 36*d* of the fourth corner receptacle 30*d*) of the integrally formed third column of the second and fourth corner receptacles 30*b*, 30*d* may be formed on opposite sides of the integrally formed third column. In some embodiments, the fourth column 38*a* of the first corner receptacle 30*a* and the fourth column 38*b* of the second corner receptacle 30*b* are integrally formed and/or the fourth column 38*c* of the third corner receptacle 30*c* the fourth column 38*d* of the fourth corner receptacle 30*d* are integrally formed.

Each corner receptacle 30*a*, 30*b*, 30*c*, 30*d* further includes a fourth column 38*a*, 38*b*, 38*c*, 38*d* extending up from the base 12 so as to be adjacent the second column 34*a*, 34*b*, 34*c*, 34*d* and opposite the first column 32*a*, 32*b*, 32*c*, 32*d*. In one or more embodiments, the fourth column 38*a*, 38*b*, 38*c*, 38*d* may be integrally formed with a side 20, 22 or may be spaced from the side 20, 22. The fourth column 38*a*, 38*b*, 38*c*, 38*d* includes an inwardly facing concave surface with a first surface portion 42*a*4, 42*b*4, 42*c*4, 42*d*4 adjacent the base 12 and a second surface portion 44*a*4, 44*b*4, 44*c*4, 44*d*4. The first surface portion 42*a*4, 42*b*4, 42*c*4, 42*d*4 is concave and has a first radius substantially the same as the first radius R1*a*, R1*b*, R1*c*, R1*d* of the first column 32*a*, 32*b*, 32*c*, 32*d* and the second surface portion 44*a*4, 44*b*4, 44*c*4, 44*d*4 is concave and has a second radius substantially the same as the second radius R2*a*, R2*b*, R2*c*, R2*d* of the first column 32*a*, 32*b*, 32*c*, 32*d*.

In some embodiments, the fourth column 38*a* of the first corner receptacle 30*a* and the fourth column 38*b* of the second corner receptacle 30*b* are integrally formed. Further, the integrally formed fourth column 38*a*, 38*b* may include a first concave surface comprising the concave surface of the first corner receptacle 30*a* and a second concave surface comprising the concave surface of the second corner receptacle 30*b*. In such embodiments, the first concave surface and second concave surface of the integrally formed fourth column 38*a*, 38*b* may be formed on opposite sides of the integrally formed fourth column 38*a*, 38*b*.

In one or more embodiments, the packing carton 10 may further include at least one center receptacle. The at least one center receptacle may provide the packing carton 10 with improved strength and/or rigidity. For instance, as shown in FIGS. 1 and 2, the packing carton 10 may include a first circular center receptacle 30*e* formed inward of the sides 14, 16, 20, 22 and the corner receptacles 30*a*, 30*b*, 30*c*, 30*d*. In some embodiments, the first center receptacle 30*e* may be formed by the third column 36*a* of the first receptacle 30*a*, the fourth column 38*a* of the first receptacle 30*a*, and the third column 36*b* of the second receptacle 30*b*. The first circular center receptacle 30*e* may have a first radius R1*e* adjacent base 12 substantially the same as the first radius R1*a* of the first column 32*a* of the first receptacle 30*a* and a second radius R2*e* adjacent upper edge 18 substantially the same as the second radius R2*a* of the first column 32*a* of the first corner receptacle 30*a*. In some embodiments, the first circular center receptacle 30*e* further comprises the third column 36*c* of the third corner receptacle 30*c*, the fourth column 38*c* of the third corner receptacle 30*c*, and the third column 36*d* of the fourth corner receptacle 30*d*.

In some embodiments, the first circular center receptacle 30*e* may have a single center receptacle radius. In such embodiments, the center receptacle radius may be, e.g., substantially the same as the first radius R1*a* of the first column 32*a* of the first receptacle 30*a* or substantially the same as the second radius R2*a* of the first column 32*a* of the first corner receptacle 30*a*.

Figure 7:
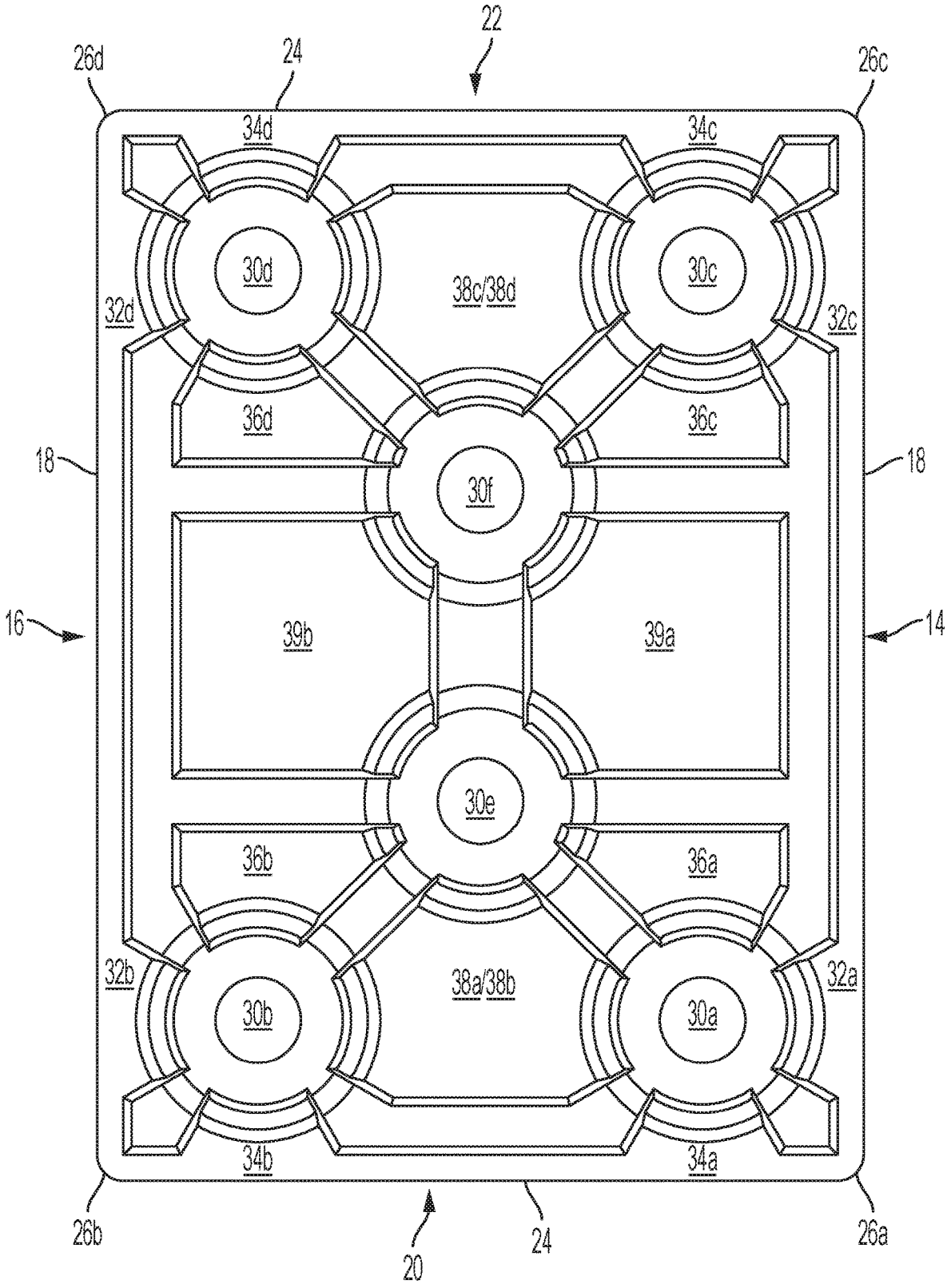
FIG. 7 is a top view of an alternative packing carton according to the present disclosure.

As best seen in FIG. 7, in some embodiments, the packing carton may include a second circular center receptacle 30*f* formed inward of the sides 14, 16, 20, 22 and the corner receptacles 30*a*, 30*b*, 30*c*, 30*d*. The second center receptacle 30*f* may be formed by the third column 36*c* of the third receptacle 30*c*, the fourth column 38*c* of the third receptacle 30*c*, and the third column 36*d* of the fourth receptacle 30*d*. The second circular center receptacle 30*f* hay have a first radius R1*e* substantially the same as the first radius R1*a* of the first column 32*a* of the first receptacle 30*a* and a second radius R2*e* substantially the same as the second radius R2*a* of the first column 32*a* of the first corner receptacle 30*a*. In some embodiments, at least one circular center receptacle 30*e*, 30*f* has a second radius substantially the same as the second radius R2*a* of the first column 32*a* of the first corner receptacle 30*a*.

In some embodiments including the first and second center receptacles 30*e*, 30*f*, the packing carton 10 may include a first center column 39*a* positioned between the third columns 36*a*, 36*c* of the first and third corner receptacles 30*a*, 30*c* and a second center column 39*b* positioned between the third columns 36*b*, 36*d* of the second and fourth corner receptacles 30*b*, 30*d*. In such an embodiment, each circular center receptacle 30*e*, 30*f* is further formed by the first and second center columns 39*a*, 39*b*. In some embodiments, each center column 39*a*, 39*b* has a first and second inwardly facing surface, each inwardly facing surface having a concave surface with a first surface portion adjacent the base 12 and a second surface portion, the first surface portion being concave and having a first radius substantially the same as the first radius R1*a* of the first column 32*a* of the first corner receptacle 30*a* and the second surface portion being concave and having a second radius substantially the same as the second radius R2*a* of the first column 32*a* of the first corner receptacle 30*a*.

In some embodiments, each column 36*a*, 36*b*, 36*c*, 36*d*, 38*a*, 38*b*, 38*c*, 38*d* forming a center receptacle 30*e*, 30*f* has an additional inwardly facing surface. Each additional inwardly facing surface of includes a concave surface with a first surface portion adjacent the base 12 and a second surface portion. The first surface portion is concave and has a first radius substantially the same as the first radius R1*a* of the first column 32*a* of the first corner receptacle 30*a*. The second surface portion is concave and has a second radius substantially the same as the second radius R2*a* of the first column 32*a* of the first corner receptacle 30*a*. For instance, as shown in FIG. 2, each third column 36*a*, 36*b*, 36*c*, 36*d* forming the center receptacle 30*e* has an additional inwardly facing surface. Each additional inwardly facing surface of a third column 36*a*, 36*b*, 36*c*, 36*d* includes a concave surface with a first surface portion 42*e*1, 42*e*2, 42*e*3, 42*e*4 adjacent the base 12 and a second surface portion 44*e*1, 44*e*2, 44*e*3, 44*e*4. The first surface portion 42*e*1, 42*e*2, 42*e*3, 42*e*4 is concave and has a first radius substantially the same as the first radius R1*a* of the first column 32*a* of the first corner receptacle 30*a*. The second surface portion 44*e*1, 44*e*2, 44*e*3, 44*e*4 is concave and has a second radius substantially the same as the second radius R2*a* of the first column 32*a* of the first corner receptacle 30*a*. Further, each fourth column 38*a*, 38*b*, 38*c*, 38*d* forming the center receptacle 30*e* has an additional inwardly facing surface. The additional inwardly facing surface of the fourth column 38*a*, 38*b*, 38*c*, 38*d* includes of a concave surface with a first surface portion 42*e*5, 42*e*6 adjacent the base 12 and a second surface portion 44*e*5, 44*e*6. The first surface portion 42*e*5, 42*e*5 is concave and has a first radius substantially the same as the first radius R1*a* of the first column 32*a* of the first corner receptacle 30*a*. The second surface portion 44*e*5, 44*e*6 is concave and has a second radius substantially the same as the second radius R2*a* of the first column 32*a* of the first corner receptacle 30*a*.

In some embodiments, the packing carton 10 may further include a third circular center receptacle 30*g* formed inward of the sides 14, 16, 20, 22 and the corner receptacles 30*a*, 30*b*, 30*c*, 30*d* and positioned between the first and second center receptacles 30*e*, 30*f* The third center receptacle 30*g* is comprised of a first, second, third and fourth center column 32*g*, 34*g*, 36*g*, 38*g*, each center column has a first and second inwardly facing surface, each inwardly facing surface of a center column comprised of a concave surface with a first surface portion 42*g*1, 42*g*2, 42*g*3, 42*g*4 adjacent the base 12 and a second surface portion 44*g*1, 44*g*2, 44*g*3, 44*g*4. The first surface portion 42*g*1, 42*g*2, 42*g*3, 42*g*4 is concave and has a first radius substantially the same as the first radius R1*a* of the first column 32*a* of the first corner receptacle 30*a*, and the second surface portion 44*g*1, 44*g*2, 44*g*3, 44*g*4 is concave and has a second radius substantially the same as the second radius R2*a* of the first column 32*a* of the first corner receptacle 30*a*.

In one or more embodiments, first set of sides 14, 16 has a first length and the second set of sides 20, 22 has a second length. In some embodiments, the second length may be shorter than the first length so that the packing carton is rectangular. In other embodiments, the first and second lengths may be equal, such that the packing carton 10 is square. In some embodiments, the first length is 200-500 mm, 300-400 mm, or 350-400 mm. In some embodiments, the second length is 200-400 mm, 200-350 mm, or 250-300 mm. In some embodiments, the first length is about 400 mm and the second length is about 300 mm. In some embodiments, a ratio of the first length to the second length is from 1 to 2, from 1 to 1.5, from 1.2 to 1.35, or from 1.25 to 1.35.

Figure 6:
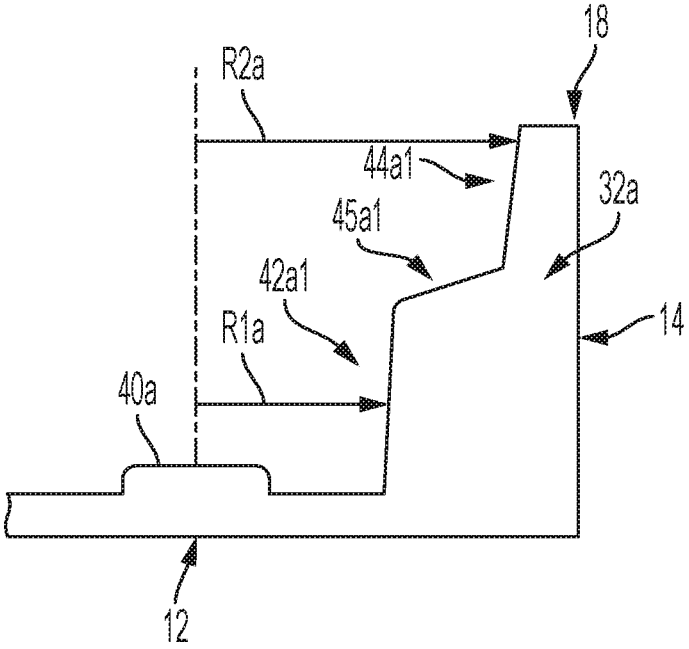
FIG. 6 is a partial side sectional view of the packing carton shown in FIG. 1.

With reference to FIG. 6, one or more embodiments of the profile of column is illustrated, utilizing column 32*a* as an example. As shown, first column 32*a* includes first surface portion 42*a*1 adjacent the base 12 and a second surface portion 44*a*1 adjacent the edge 18 of the side 14 in which the column 32*a* is formed. Each of the first portion 44*a*1 and the second portion 42*a*1 include an inwardly facing concave surface with a radius. The first surface portion 42*a*1 is concave and has a first radius R1*a*, while the second surface portion 44*a*1 is concave and has a second radius R2*a* that is greater than the first radius R1*a*. The intersection of the first surface portion 42*a*1 and the second surface portion 44*a*1 of the first column 32*a* forms an inwardly extending shoulder 45*a*1 between the surface portions. As shown, in some embodiments, the shoulder 45*a*1 may slope downward towards the base 12 from the second surface portion 44*a*1 to the first surface portion 42*a*1. Any of the columns described herein may include such a shoulder between the first and second surface portions. Also shown in FIG. 7 is a circular relief 40*a* which may be included in the center of each receptacle.

With reference back to FIG. 2, each concave surface has a width W. For example, with respect to circular receptacle 30*a*, first column 32*a* has a width W1, second column 34*a* has a width W2, third column 36*a* has a width W3 and fourth column 38*a* has a width W4. In some embodiments, the concave surface width W of the fourth column 38*a*, 38*b*, 38*c*, 38*d* may be greater than the concave surface width of the first column 32*a*, 32*b*, 32*c*, 32*d*, which may be greater than the concave surface width of the second column 34*a*, 34*b*, 34*c*, 34*d*, which may be greater than the concave surface width of the third column 36*a*, 36*b*, 36*c*, 36*d*. In other embodiments, one or more of the concave surfaces may have the same width. In some embodiments, all of the concave surfaces have the same width.

The relative positions of the concave surfaces is not particularly limited. In some embodiments, the concave surfaces of the first column 32*a*, 32*b*, 32*c*, 32*d* and the fourth column 38*a*, 38*b*, 38*c*, 38*d* may be angularly offset from one another approximately 180 degrees apart about the circular receptacle, and the concave surfaces of the second column 34*a*, 34*b*, 34*c*, 34*d* and the third column 36*a*, 36*b*, 36*c*, 36*d* may be angularly offset from one another less than 180 degrees.

In one or more embodiments, a slot 54 may be formed between a certain column and its adjacent side. For instance, with reference to FIG. 2, a slot 54*a*, 54*b*, 54*c*, 54*d* may be formed between third column 36*a*, 36*b*, 36*c*, 36*d* and a side 14, 16 adjacent the third column 36*a*, 36*b*, 36*c*, 36*d*. In some embodiments, the slot 54*a* between the third column 36*a* of the first receptacle 30*a* and side 14 and the slot 54*c* between the third column 36*c* of the third receptacle 30*c* and side 14 may be integrally formed. Similarly, in some embodiments, the slot 54*b* between the third column 36*b* of the second receptacle 30*b* and side 16 and the slot 54*d* between the third column 36*d* of the fourth receptacle 30*d* and side 16 may be integrally formed. In some embodiments, the slot 54*a*, 54*b*, 54*c*, 54*d* is formed between each third column 36*a*, 36*b*, 36*c*, 36*d* and the side 14, 16 adjacent the third column 36*a*, 36*b*, 36*c*, 36*d*. In some embodiments, the first column 32*a*, 32*b*, 32*c*, 32*d* and the second column 34*a*, 34*b*, 34*c*, 34*d* are spaced apart from one another to form a slot 56*a*, 56*b*, 56*c*, 56*d* therebetween. In some embodiments, the fourth column 38*a*, 38*b*, 38*c*, 38*d* may be spaced apart from a side of the second set of opposing sides 20, 22 to form a slot 58*a*, 58*c* between at least a portion of the fourth column 38*a*, 38*b*, 38*c*, 38*d* and the side 20, 22. In one or more embodiments, a first slot may be formed between a first pair of adjacent columns of a circular receptacle and a second slot may be formed between a second pair of adjacent columns of the circular receptacle. The columns forming the first pair of adjacent columns may be different than the columns forming the second pair of adjacent columns. For instance, with respect to the first corner receptacle 30*a*, a first slot 56*a* may be formed between columns 32*a* and 34*a* while a second slot 57*a* is formed between columns 36*a* and 38*a*. In such an embodiment, the first and second slots 56*a*, 57*a* generally oppose one another about the circular receptacle 30*a*. In some embodiments, such as that shown in FIG. 2, a slot 54*a*, 56*a*, 57*a*, 58*a* may be formed between each pair of adjacent columns of a circular receptacle, thereby forming a first slot, a second slot, a third slot and a fourth slot for each circular receptacle.

According to the embodiments above, the slots may provide the packing carton 10 with improved strength and/or may facilitate nesting of stacked packing cartons 10. Moreover, in some embodiments, the slots may allow for easy insertion and/or removal of valve heads and/or valve seats from the packing carton 10. For instance, the slots may be configured to allow for a robotic arm to insert or remove valve heads and/or valve seats from the packing carton 10.

In one or more embodiments, one or more column may be formed in relief. In some embodiments, each column is formed in relief. For instance, each column may extend from the base 12 in relief.

Figure 8:
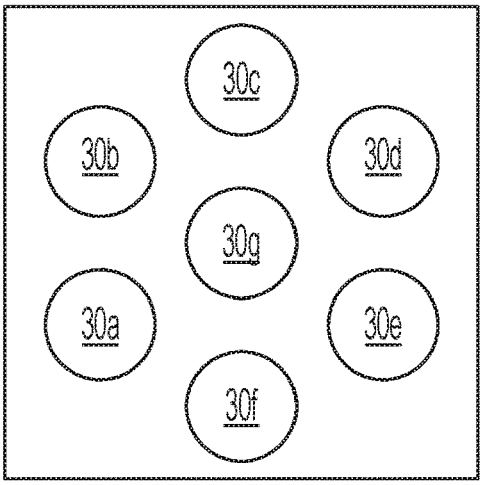
FIG. 8 is a top view of an alternative packing carton according to the present disclosure.

In some embodiments, the packing carton 10 includes at least 4 receptacles. In some embodiments, the packing carton 10 includes 5 receptacles (e.g., as shown in FIG. 1), 6 receptacles (e.g., as shown in FIG. 7), or 7 receptacles (e.g., as shown in FIG. 8). Although not shown in the present drawings, the packing carton 10 may include greater than 7 receptacles.

Figure 9A:
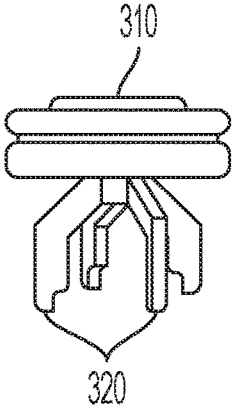
FIG. 9A is a side view of a valve head usable with a packing carton according to the present disclosure.
Figure 9B:
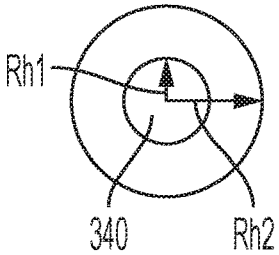
FIG. 9B is a top view of the valve head shown in FIG. 9A.
Figure 9C:
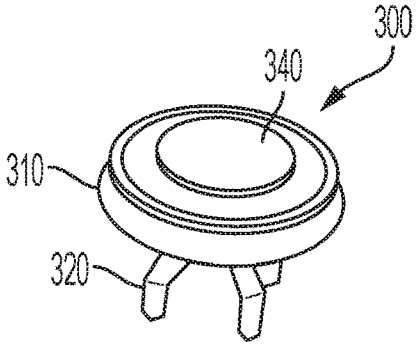
FIG. 9C is a perspective view of the valve head shown in FIG. 9A.

In one or more embodiments, the receptacles of packing carton 10 may be configured to accommodate a pump valve head 300, a non-limiting illustration of which is shown in the example of FIGS. 9A-9C. In general, a circular valve head 300 may include an upper portion in the form of a valve body 310, which upper portion is supported by a lower portion, in the form of a valve stem or legs 320. Thus, it will be appreciated that in some embodiments, carton 10 may accommodate multiple valve heads 300 such as is shown. The first surface portions (e.g., 42*a*1) of each receptacle may be configured to have a radius (e.g., R1*a*) that is greater than the radius of the legs 320 so as to receive legs 320, and the second surface portions (e.g., 44*a*1) of each receptacle may be configured to have a radius (e.g., R2*a*) that is greater than the radius of the valve body 310 so as to receive valve body 310. For instance, with reference to FIGS. 2 and 9B, the value of R2*a* may be greater than Rh2 and the value of R1*a* may be greater than a radius of the legs 320 such that the first corner receptacle 30*a* may receive valve head 300, wherein the smaller diameter legs 320 are received adjacent the lower first surface portions 42*a*1, 42*a*2, 42*a*3 and 42*a*4 of receptacle 30*a*, while the larger diameter body 310 of valve head 300 is received adjacent the upper second surface portions 44*a*1, 44*a*2, 44*a*3, 44*a*4 of receptacle 30*a*. For example, in some valve heads 300, the value of Rh2 may be 100-150 mm, 110-140 mm, 110-130 mm, 114 mm, or 127 mm and thus, cartons 10 disposed to receive such valve heads may have an R2 radius of 105-155 mm, 115-145 mm, 115-135 mm, 120 mm, or 130 mm, respectively. In one or more embodiments, the packing carton 10 has a height Hc measured from the base 12 to the edge 18, 24. In some embodiments, the height Hc is selected to be equal to or greater than the height Hh of a valve head 300 that carton 10 is disposed to receive, where Hh may be measured from a base of the legs 320 to an upper surface of the valve body 310. For example, in some valve heads, height Hh may be 70-120 mm, 80-100 mm, 87 mm, or 95 mm, and thus, carton 10 may have a height Hc of 70-130 mm, 80-110 mm, 90-100 mm, or 100 mm for receipt of a correspondingly sized valve head 300.

Additionally, the cartons 10 as described herein may be stacked one on top of another once packed with valve heads 300. In this regard, many valve heads include a spring guide 340, which is a circular raised portion extending from an upper surface of the valve body 310 opposite the legs 320 (see FIGS. 9*a* and 9*c*). Thus, in some embodiments of the present disclosure, the packing carton 10 may include one or more circular reliefs 40*a*, as best seen in FIG. 2 and FIG. 6, configured to accommodate the spring guide 340 of a valve head 300 in a packing carton on which above which a packing carton 10 with reliefs 40*a* is stacked. Specifically, when a plurality of packing cartons 10 are loaded with valve heads 300 and stacked on top of each other, the circular reliefs 40*a* may be situated over the spring guides 340 providing stability to the stacked packing cartons 10. That is, the foregoing configuration may prevent relative lateral movement between the stacked packing cartons 10. In some embodiments, the circular reliefs 40*a* are included in the center of each receptacle, coaxial with the receptacle. The circular reliefs 40*a* may have a radius R3*a* that is configured to be greater than a radius Rh1 of the valve head 300 that packing carton 10 is disposed to receive. Although the spring guides 340 and circular reliefs 40*a* have been depicted as circular, the reliefs 40*a* may be any shape so long as the reliefs 40*a* are able to accommodate at least a portion of the spring guides 340.

Figure 10:
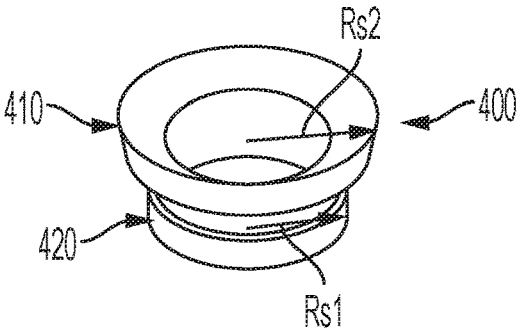
FIG. 10 is a perspective view of a valve seal usable with a packing carton according to the present disclosure.

In addition to being disposed for receipt of valve heads 300, the embodiments of the carton 10 described herein can alternately accommodate valve seats, such as the valve seat 400 shown in FIG. 10. In general, a valve seat 400 includes a large diameter upper portion 410 having a radius Rs2 and a small diameter lower portion 420 having a radius Rs1. As such, in some embodiments of the carton 10, the first surface portions (e.g., 42*a*1) of each receptacle (e.g., 30*a*) may be configured to have a radius (e.g., R1*a*) that is disposed to receive the upper portion 410 of a valve seat 400, and the second surface portions (e.g., 44*a*1) of each receptacle (e.g., 30*a*) may be configured to have a radius (e.g., R2*a*) that is disposed to receive the lower portion 420 of a valve seat 400. For instance, with reference to FIGS. 2 and 10, the value of R2*a* may be greater than the radius Rs2 of the valve seat 400 that carton 10 is to receive and the value of R1*a* may be greater than the radius Rs1 of the valve seat that carton 10 is to receive. For example, a valve seat 400 may have a Rs2 radius of 100-150 mm, 110-140 mm, or 110-130 mm, and thus, the radius R2 of the carton 10 should be selected to receive a valve seat of such dimensions. In some embodiments, the height Hc of the packing carton 10 is selected to be equal to or greater than the axial height of a valve seat 400 that carton 10 is disposed to receive. For example, in some valve seats, the axial height of the valve seat 400 may be 70-120 mm, 80-100 mm, 87 mm, or 95 mm, and thus, carton 10 may have a height Hc of 70-130 mm, 80-110 mm, 90-100 mm, or 100 mm for receipt of a correspondingly sized valve seat 400.

In some embodiments, the packing carton 10 may include a circular rib 55*a* extending from the base 12 and coaxial with a circular receptacle. The circular rib 55*a* may be configured to intersect with each of the first, second, third and fourth columns of a receptacle (e.g., 30*a*). For instance, as shown in FIG. 2, circular rib 55*a* intersects with columns 32*a*, 34*a*, 36*a*, and 38*a* of the first corner receptacle 30*a*. In some embodiments, the circular relief 55*a* may provide the packing carton 10 with improved strength, may allow for a more secure nestling of stacked packing cartons 10, and/or may provide a more secure fit for a valve head or valve seat stored in the receptacle.

The packing carton 10 may be made of any suitable material and may include more than one material. In some embodiments, the packing carton 10 is formed of molded paper. In some embodiments, the packing carton 10 is formed of molded paper, plastic, metal, or combinations thereof.

According to embodiments of the present disclosure, the packing carton 10 may provide a variety of beneficial effects, as discussed above. These beneficial effects include, but are not limited to, improved manufacturing efficiency, improved efficiency for workers transporting valve heads and/or valve seats (e.g., to a frac pump), secure stacking of filled cartons, improved nesting of empty cartons, and improved carton strength. Further, according to some embodiments of the present disclosure, due to the plural radii of each corner receptacle, the packing carton may accommodate a variety of size of valve heads and/or valve seats.

What is claimed is:

1. A packing carton for pump valves, the packing carton comprising:

a base;

a first set of opposing sides extending up from the base, each side of the first set having an upper edge;

a second set of opposing sides extending up from the base, each side of the second set having an upper edge, whereby adjacent sides join together to form a corner;

a first circular corner receptacle formed at a first corner;

a second circular corner receptacle formed at a second corner and adjacent the first circular receptacle;

a third circular corner receptacle formed at a third corner;

a fourth circular corner receptacle formed at a fourth corner and adjacent the third circular corner receptacle; wherein each circular corner receptacle comprises:

a first column extending up from the base, the first column integrally formed with a side and having an inwardly facing concave surface with a first surface portion adjacent the base and a second surface portion adjacent the upper edge of the side in which the column is formed, the first surface portion being concave and having a first radius and the second surface portion being concave and having a second radius greater than the first radius;

a second column extending up from the base, the second column integrally formed with a side and having an inwardly facing concave surface with a first surface portion adjacent the base and a second surface portion adjacent the edge of the wall in which the column is formed, the first surface portion being concave and having a first radius substantially the same as the first radius of the first column and the second surface portion being concave and having a second radius substantially the same as the second radius of the first column, wherein the first and second columns are adjacent one another on their respective sides at a corner;

a third column extending up from the base so as to be adjacent the first column and opposite the second column, the third column having an inwardly facing concave surface with a first surface portion adjacent the base and a second surface portion, the first surface portion being concave and having a first radius substantially the same as the first radius of the first column and the second surface portion being concave and having a second radius substantially the same as the second radius of the first column; and a fourth column extending up from the base so as to be adjacent the second column and opposite the first column, the fourth column having an inwardly facing concave surface with a first surface portion adjacent the base and a second surface portion, the first surface portion being concave having a first radius substantially the same as the first radius of the first column and the second surface portion being concave and having a second radius substantially the same as the second radius of the first column; and a first circular center receptacle formed inward of the sides and the circular corner receptacles, the first circular center receptacle comprised of the third column of the first circular corner receptacle, the fourth column of the first circular corner receptacle and the third column of the second circular corner receptacle, the first circular center receptacle having a first radius substantially the same as the first radius of the first column of the first circular corner receptacle and the first circular center receptacle having a second radius substantially the same as the second radius of the first column of the first circular corner receptacle.

2. The packing carton of claim 1, wherein each third column forming the first circular center receptacle has an additional inwardly facing surface, each additional inwardly facing surface of the third column comprised of a concave surface with a first surface portion adjacent the base and a second surface portion, the first surface portion being concave and having a first radius substantially the same as the first radius of the first column and the second surface portion being concave and having a second radius substantially the same as the second radius of the first column; and each fourth column forming a center receptacle has an additional inwardly facing surface, the additional inwardly facing surface of the fourth column comprised of a concave surface with a first surface portion adjacent the base and a second surface portion, the first surface portion being concave and having a first radius substantially the same as the first radius of the first column and the second surface portion being concave and having a second radius substantially the same as the second radius of the first column.

3. The packing carton of claim 1, wherein each column forming a center receptacle has an additional inwardly facing surface, each additional inwardly facing surface of each column comprised of a concave surface with a first surface portion adjacent the base and a second surface portion, the first surface portion being concave and having a first radius substantially the same as the first radius of the first column and the second surface portion being concave and having a second radius substantially the same as the second radius of the first column.

4. The packing carton of claim 1, wherein the first circular center receptacle further comprises the third column of the third circular corner receptacle, the fourth column of the third circular corner receptacle and the third column of the fourth circular corner receptacle.

5. The packing carton of claim 1, further comprising a second circular center receptacle formed inward of the sides and the circular corner receptacles, the second circular center receptacle comprising the third column of the third circular corner receptacle, the fourth column of the third circular corner receptacle and the third column of the fourth circular corner receptacle, the second circular center receptacle having a first radius substantially the same as the first radius of the first column of the first circular corner receptacle and the second circular center receptacle having a second radius substantially the same as the second radius of the first column of the first circular corner receptacle.

6. The packing carton of claim 5, further comprising a first center column positioned between the third center columns of the first and third circular corner receptacles and a second center column positioned between the third center columns of the second and fourth circular receptacles, wherein each circular center receptacle is further comprised of the first and second center columns.

7. The packing carton of claim 6, wherein each center column has a first and second inwardly facing surface, each inwardly facing surface of each center column comprised of a concave surface with a first surface portion adjacent the base and a second surface portion, the first surface portion being concave and having a first radius substantially the same as the first radius of the first column and the second surface portion being concave and having a second radius substantially the same as the second radius of the first column.

8. The packing carton of claim 5, further comprising a third circular center receptacle formed inward of the sides and the circular corner receptacles and positioned between the first and second circular center receptacles, the third circular center receptacle comprised of a first, second, third and fourth center column, each center column has a first and second inwardly facing surface, each inwardly facing surface of each center column comprised of a concave surface with a first surface portion adjacent the base and a second surface portion, the first surface portion being concave and having a first radius substantially the same as the first radius of the first column of the first circular corner receptacle and the second surface portion being concave and having a second radius substantially the same as the second radius of the first column of the first circular corner receptacle.

9. The packing carton of claim 1, wherein the fourth column of the first circular corner receptacle and the fourth column of the second circular corner receptacle are integrally formed.

10. The packing carton of claim 9, wherein the integrally formed fourth column has a first concave surface comprising the concave surface of the first circular corner receptacle and a second concave surface comprising the concave surface of the second circular corner receptacle.

11. The packing carton of claim 10, wherein the first concave surface and second concave surface of the integrally formed fourth column are formed on opposite sides of the integrally formed fourth column.

12. The packing carton of claim 1, wherein the first set of sides has a first length and the second set of sides has a second length shorter than the first length so that the packing carton is rectangular in shape.

13. The packing carton of claim 1, wherein the packing carton has five circular receptacles.

14. The packing carton of claim 1, wherein the packing carton has at least six circular receptacles.

15. The packing carton of claim 1, wherein the first surface portion and the second surface portion of each column form an inwardly extending shoulder between the surface portions.

16. The packing carton of claim 15, wherein the shoulder slopes downward towards the base from the second surface portion to the first surface portion.

17. The packing carton of claim 1, further comprising a circular relief extending from the base and coaxial with one of the circular corner receptacle or circular center receptacle.

18. The packing carton of claim 1, further comprising a slot formed between one of the third columns and one of the sides of the carton adjacent the third column.

19. The packing carton of claim 1, further comprising a slot formed between each third column and a carton side adjacent the third column.

20. The packing carton of claim 1, wherein each column extends from the base in relief.

21. The packing carton of claim 1, further comprising a circular rib extending from the base and coaxial with one of the circular corner receptacle or the circular center receptacle, the circular rib intersecting with each of the first, second, third and fourth columns of a receptacle.

22. The packing carton of claim 1, wherein each concave surface has a width, wherein the concave surface width of the fourth column is greater than the concave surface width of the first column which is greater than the concave surface width of the second column which is greater than the concave surface width of the third column.

23. The packing carton of claim 1, wherein the concave surfaces of the first and fourth column are angularly offset from one another approximately 180 degrees apart about each circular corner receptacle, and wherein the concave surfaces of the second and third columns are angularly offset from one another less than 180 degrees.

24. The packing carton of claim 1, wherein the first and second columns are spaced apart from one another to form a slot therebetween.

25. The packing carton of claim 1, wherein the third column is spaced apart from a side of the first set of opposing sides to form a slot between at least a portion of the third column and side.

26. The packing carton of claim 1, wherein the carton is formed of molded paper.

27. The packing carton of claim 1, wherein a first slot is formed between a first pair of adjacent columns of one of the circular corner receptacles or circular center receptacle and a second slot is formed between a second pair of adjacent columns of one of the circular corner receptacles or circular center receptacle.

28. The packing carton of claim 27, wherein the columns forming the first pair of adjacent columns are different than the columns forming the second pair of adjacent columns.

29. The packing carton of claim 1, wherein a first slot is formed between a first pair of adjacent columns of one of the circular corner receptacles or circular center receptacle and a second slot is formed between a second pair of adjacent columns of one of the circular corner receptacles or circular center receptacle, wherein the first and second slots generally oppose one another about the circular receptacle.

30. The packing carton of claim 1, further comprising a slot formed between each pair of adjacent columns of one of the circular corner receptacles or circular center receptacle, thereby forming a first slot, a second slot, a third slot and a fourth slot for each circular receptacle.

31. A packing carton for pump valves, the packing carton comprising:

a base;

a first set of opposing sides extending up from the base, each side of the first set having an upper edge;

a second set of opposing sides extending up from the base, each side of the second set having an upper edge, whereby adjacent sides join together to form a corner;

a first circular corner receptacle formed at a first corner;

a second circular corner receptacle formed at a second corner and adjacent the first receptacle;

a third circular corner receptacle formed at a third corner;

a fourth circular corner receptacle formed at a fourth corner and adjacent the third receptacle;

wherein each circular corner receptacle comprises:

a first column extending up from the base, the first column integrally formed with a side and having an inwardly facing concave surface with a first surface portion adjacent the base and a second surface portion adjacent the upper edge of the side in which the column is formed, the first surface portion being concave and having a first radius and the concave second surface portion having a second radius greater than the first radius;

a second column extending up from the base, the second column integrally formed with a side and having an inwardly facing concave surface with a first surface portion adjacent the base and a second surface portion adjacent the upper edge of the side in which the column is formed, the first surface portion being concave and having a first radius substantially the same as the first radius of the first column and the second surface portion being concave and a second radius substantially the same as the second radius of the first column, wherein the first and second columns are adjacent one another on their respective sides at a corner;

a third column extending up from the base so as to be adjacent the first column and opposite the second column, the third column having an inwardly facing concave surface with a first surface portion adjacent the base and a second surface portion, the first surface portion being concave and having a first radius substantially the same as the first radius of the first column and the second surface portion being concave and a second radius substantially the same as the second radius of the first column; and a fourth column extending up from the base so as to be adjacent the second column and opposite the first column, the fourth column having an inwardly facing concave surface with a first surface portion adjacent the base and a second surface portion, the first surface portion being concave and having a first radius substantially the same as the first radius of the first column and the second surface portion being concave and a second radius substantially the same as the second radius of the first column; and a first circular center receptacle formed inward of the sides and the circular corner receptacles, the first circular center receptacle comprised of the third column of the first circular corner receptacle, the fourth column of the first circular corner receptacle and the third column of the second circular corner receptacle, the first circular center receptacle having a center receptacle radius.

32. The packing carton of claim 31, wherein the center receptacle radius is substantially the same as the first radius of the first column of the first circular corner receptacle.

33. The packing carton of claim 31, wherein the center receptacle radius is substantially the same as the second radius of the first column of the first circular corner receptacle.

34. A packing carton for pump valves, the packing carton comprising:

a base;

a first set of opposing sides extending up from the base, each side of the first set having an upper edge;

a second set of opposing sides extending up from the base, each side of the second set having an upper edge, whereby adjacent sides join together to form a corner;

a first circular corner receptacle formed at a first corner;

a second circular corner receptacle formed at a second corner and adjacent the first receptacle;

a third circular corner receptacle formed at a third corner;

a fourth circular corner receptacle formed at a fourth corner and adjacent the third receptacle;

wherein each corner receptacle comprises:

a first column extending up from the base, the first column integrally formed with a side and having an inwardly facing concave surface with a first surface portion adjacent the base and a second surface portion adjacent the upper edge of the side in which the column is formed, the concave first surface portion having a first radius and the concave second surface portion having a second radius greater than the first radius;

a second column extending up from the base, the second column integrally formed with a side and having an inwardly facing concave surface with a first surface portion adjacent the base and a second surface portion adjacent the upper edge of the side in which the column is formed, the concave first surface portion having a first radius substantially the same as the first radius of the first column and a second radius substantially the same as the second radius of the first column, wherein the first and second columns are adjacent one another on their respective sides at a corner;

a third column extending up from the base so as to be adjacent the first column and opposite the second column, the third column integrally formed with a side and having an inwardly facing concave surface with a first surface portion adjacent the base and a second surface portion, the concave first surface portion having a first radius substantially the same as the first radius of the first column and a second radius substantially the same as the second radius of the first column;

a fourth column extending up from the base so as to be adjacent the second column and opposite the first column, the fourth column integrally formed with a side and having an inwardly facing concave surface with a first surface portion adjacent the base and a second surface portion, the concave first surface portion having a first radius substantially the same as the first radius of the first column and a second radius substantially the same as the second radius of the first column;

wherein the third column of the first circular corner receptacle and the third column of the third circular corner receptacle are integrally formed; and wherein the third column of the second circular corner receptacle and the third column of the fourth circular corner receptacle are integrally formed.

35. The packing carton of claim 34, wherein a concave first surface portion and a concave second surface portion of the integrally formed third column of the first and third circular corner receptacles are formed on opposite sides of the integrally formed third column.

36. The packing carton of claim 34, wherein a concave first surface portion and a concave second surface portion of the integrally formed third column of the second and fourth circular corner receptacles are formed on opposite sides of the integrally formed third column.

37. The packing carton of claim 34, wherein the first set of sides has a first length and the second set of sides has a second length substantially the same as the first length so that the carton is square in shape.

38. The packing carton of claim 34, further comprising a first circular center receptacle formed inward of the sides and the first, second, third, and fourth circular corner receptacles, the first circular center receptacle comprised of the third column of the first circular corner receptacle, the fourth column of the first circular corner receptacle, the third column of the fourth circular corner receptacle, and the fourth column of the fourth corner receptacle, the first circular center receptacle having a first radius substantially the same as the first radius of the first column of the first circular corner receptacle and the first circular center receptacle having a second radius substantially the same as the second radius of the first column of the first circular corner receptacle, wherein the fourth column of the first circular corner receptacle and the fourth column of the second circular corner receptacle are integrally formed and the fourth column of the third circular corner receptacle and the fourth column of the fourth circular corner receptacle are integrally formed.

39. The packing carton of claim 34, further comprising a circular relief extending from the base adjacent each circular corner receptacle, each circular relief coaxial with one of the circular corner receptacles.

* * * * *